US006976942B2

(12) United States Patent
Kennedy

(10) Patent No.: US 6,976,942 B2
(45) Date of Patent: Dec. 20, 2005

(54) BODY TONER EXERCISE DEVICE

(76) Inventor: Robert D. Kennedy, 56 Robert Street, Ottawa, Ontario (CA) K2P 1G4

( * ) Notice: Subject to any disclaimer, the term of this patent is extended or adjusted under 35 U.S.C. 154(b) by 341 days.

(21) Appl. No.: 10/465,664

(22) Filed: Jun. 20, 2003

(65) Prior Publication Data

US 2004/0259701 A1 Dec. 23, 2004

(51) Int. Cl.[7] ..... A63B 21/055
(52) U.S. Cl. ..... 482/122; 482/125; 482/126
(58) Field of Search ..... 482/44, 49, 77, 482/92, 110, 121–126; D21/692–693

(56) References Cited

U.S. PATENT DOCUMENTS

| | | | | | |
|---|---|---|---|---|---|
| 3,343,837 | A | * | 9/1967 | Grzybowski | 482/126 |
| 3,544,106 | A | * | 12/1970 | Barrett | 482/126 |
| 4,239,212 | A | | 12/1980 | Hickey | |
| 4,257,592 | A | | 3/1981 | Jones | |
| 4,290,600 | A | | 9/1981 | Kölbel | |
| 4,580,778 | A | | 4/1986 | Van Noord | |
| 4,775,149 | A | * | 10/1988 | Wilson | 482/126 |
| 4,951,941 | A | | 8/1990 | Resk | |
| 5,031,906 | A | | 7/1991 | Jang | |
| 5,232,425 | A | | 8/1993 | Miller et al. | |
| 5,480,367 | A | * | 1/1996 | Bergman | 482/122 |
| 5,509,879 | A | | 4/1996 | Lanzagorta | |
| 5,637,066 | A | | 6/1997 | Chang | |
| 5,695,436 | A | | 12/1997 | Huang | |
| 5,697,873 | A | | 12/1997 | Van Straaten | |
| 5,746,686 | A | * | 5/1998 | Berman et al. | 482/125 |
| D405,133 | S | | 2/1999 | Morgan | |
| D408,063 | S | | 4/1999 | Van Der Hoeven et al. | |
| 5,911,535 | A | | 6/1999 | Gvoich | |
| 6,193,638 | B1 | * | 2/2001 | Barrett | 482/128 |
| 6,315,701 | B1 | | 11/2001 | Shifferaw | |
| D460,795 | S | | 7/2002 | Fitzpatrick | |

* cited by examiner

*Primary Examiner*—Gregory L. Huson
*Assistant Examiner*—Victor K. Hwang
(74) *Attorney, Agent, or Firm*—Jeffrey L. Costellia; Nixon Peabody LLP

(57) ABSTRACT

A portable personal exercise device comprising an elongated, linear rigid bar with opposing ends. An anchor sleeve is fixedly secured to each end and a pair of handles is mounted to the bar for only linear sliding movement between the anchor sleeves. The handles extending outwardly from the bar. The anchor sleeves define the limits of movement of the handles toward the ends of the bar and the handle sleeves and anchor sleeves are provided with the aligned parallel projections for releasably securably receiving one or more elastic bands in alternative arrangements so as alternatively to bias the handles with respect to each other or with respect to the anchor sleeves against relative movement towards or away from each other or towards or away from corresponding anchor sleeves whereby a variety of exercises may be performed.

9 Claims, 4 Drawing Sheets

BODY TONER EXERCISE DEVICE

FIELD OF THE INVENTION

The present invention relates to a portable personal exercise device which will permit multiple exercises to be performed.

BACKGROUND OF THE INVENTION

Portable exercise devices permitting multiple exercises to be performed are well known. Of general background interest are U.S. Pat. No. 5,911,535 of Groich issued Jun. 15, 1999, U.S. Pat. No. 4,580,778 of Van Noord issued Apr. 8, 1986, U.S. Pat. No. 4,951,941 of Resk issued Aug. 28, 1990, U.S. Pat. No. 4,290,600 of Kölbel issued Sep. 22, 1981, U.S. Design Pat. No. Des. 408,063 of Van Der Hoeven et al., issued Apr. 13, 1999, U.S. Pat. No. 4,239,212 of Hickey issued Dec. 16, 1980, U.S. Design Pat. No. U.S. D460,795 of Fitzpatrick issued Jul. 23, 2002, U.S. Pat. No. 5,509,879 of Lanzagorta issued Apr. 23, 1996 and U.S. Pat. No. 5,695,436 of Huang issued Dec. 9, 1997.

Also of interest are U.S. Pat. Nos. 6,315,701 of Shifferaw issued Nov. 13, 2001 and U.S. Pat. No. 4,257,592 of Jones issued Mar. 24,1981, which describe and illustrate bars with expandible ropes extending from their ends to permit a variety of exercises. Limited numbers of exercises are possible with the exercise devices of Morgan U.S. Design Pat. No. Des. 405,133 issued Feb. 2, 1999, Chang U.S. Pat. No. 5,637,066 issued Jun. 10, 1997, Van Straaten U.S. Pat. No. 5,697,873 issued Dec. 16, 1997 which teach various arrangements of bars with parts relatively moveable with respect to each other under bias, to permit exercising. Jang U.S. Pat. No. 5,031,906 issued Jul. 16, 1991 describes and illustrates a bar type exercising machine in which the moveable components are biased by means of a piston type arrangement against relative movement. U.S. Pat. No. 5,232,425 issued Aug. 3, 1993 describes an elastic band-biased bar type exercise device for abdominal muscles.

It is an object of the present invention to provide a portable personal exercise device which is simple and economic in construction and which will permit a large number of exercises to be carried out.

SUMMARY OF THE INVENTION

In accordance with the present invention there is provided a portable personal exercise device comprising an elongated, linear rigid bar with opposing ends. An anchor sleeve is fixedly secured to each end and a pair of handles is mounted to the bar for only linear sliding movement between the anchor sleeves. The handles extend outwardly from the bar. The anchor sleeves define the limits of movement of the handles toward the ends of the bar and the handle sleeves and anchor sleeves are provided with the aligned parallel projections for releasably securably receiving one or more elastic bands in alternative arrangements so as alternatively to bias the handles with respect to each other or with respect to the anchor sleeves against relative movement towards or away from each other or towards or away from corresponding anchor sleeves whereby a variety of exercises may be performed.

The device according to the present invention permits multiple exercises to be performed, depending upon the number of elastic bands used and their arrangement, as will be described in more detail hereinafter.

In one embodiment of the present invention, a pair of elastic bands are used, one releasably secured to the projection of one of the handles and the projection of the corresponding anchor sleeve and the other band releasably secured to the projection of the other handle and its corresponding anchor sleeve, whereby the handles are biased against relative movement towards each other.

In another embodiment, an elastic band is releasably secured to the projections of the handles, whereby the handles are biased against relative movements away from each other.

In a further embodiment of the present invention, a single elastic band is releasably secured to the projection of one of the handles and the projection of the corresponding anchor sleeve to bias that handle against relative movement away from the corresponding anchor sleeve.

In yet a further embodiment of the present invention, an attachment loop is secured to each end of the bar and, linear elastic lines are provided, each linear elastic line having at one end a handle and at the other a clip for releasable attachment to one of the attachment loops.

The exercise device according to the present invention is both simple and economical in its construction, while permitting a significant number of exercises to be performed.

BRIEF DESCRIPTION OF THE DRAWINGS

These and other advantages of the invention will become apparent upon reading the following detailed description and upon referring to the drawings in which.

DETAILED DESCRIPTION OF THE PREFERRED EMBODIMENTS

Figure 1:
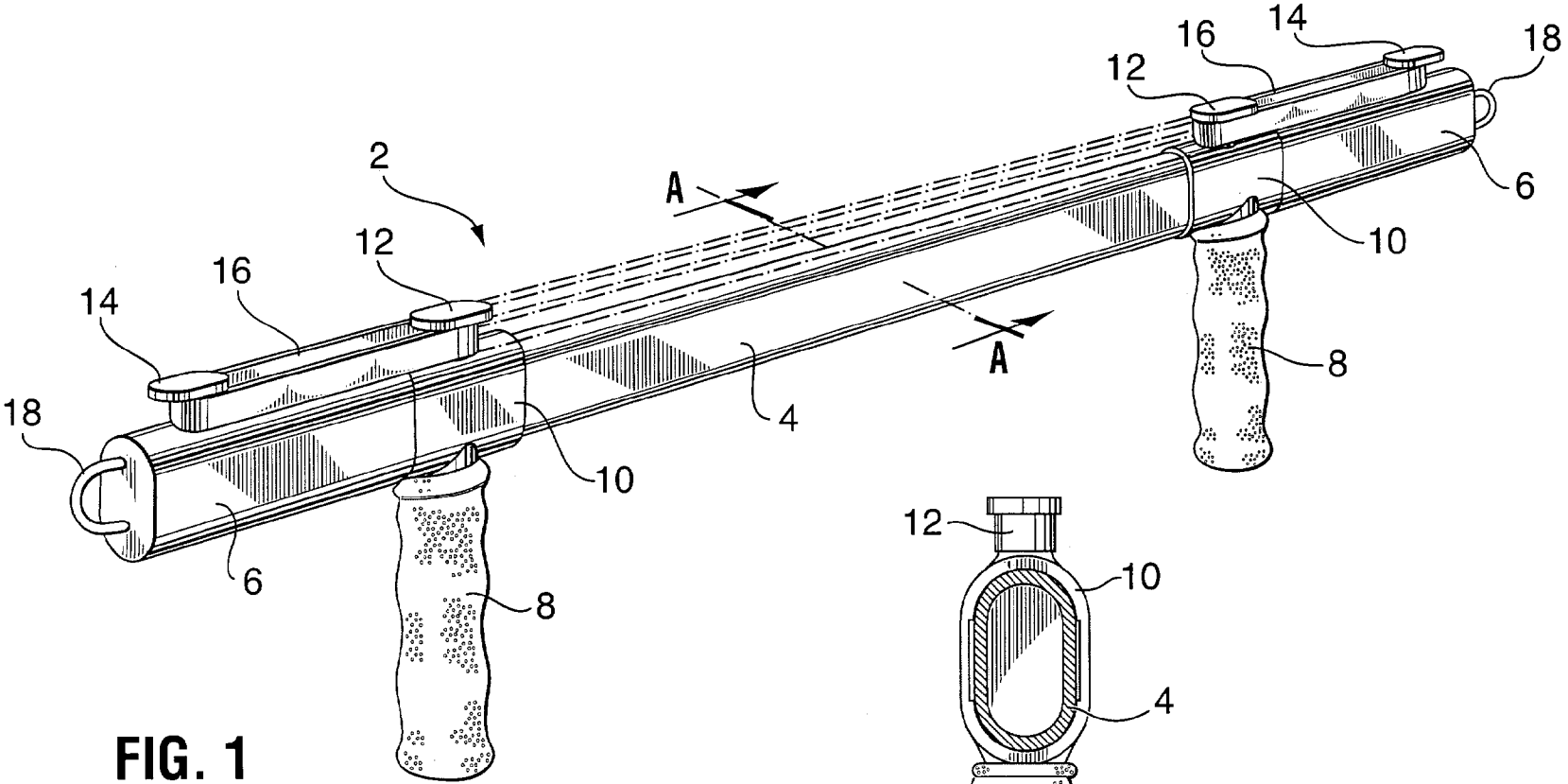
FIG. 1 is a perspective view of the portable personal exercise device according to the present invention.

In the following description, similar features in the drawings have been given similar reference numerals.

Figure 2:
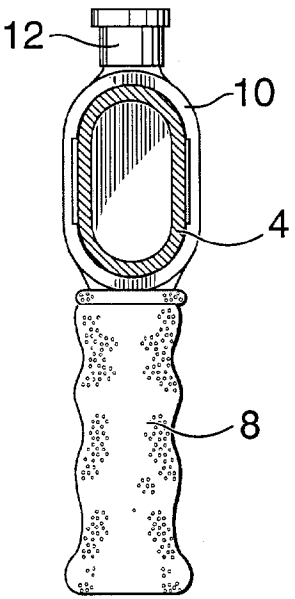
FIG. 2 is a cross-section view of the device along line A—A of FIG. 1.
Figure 3:
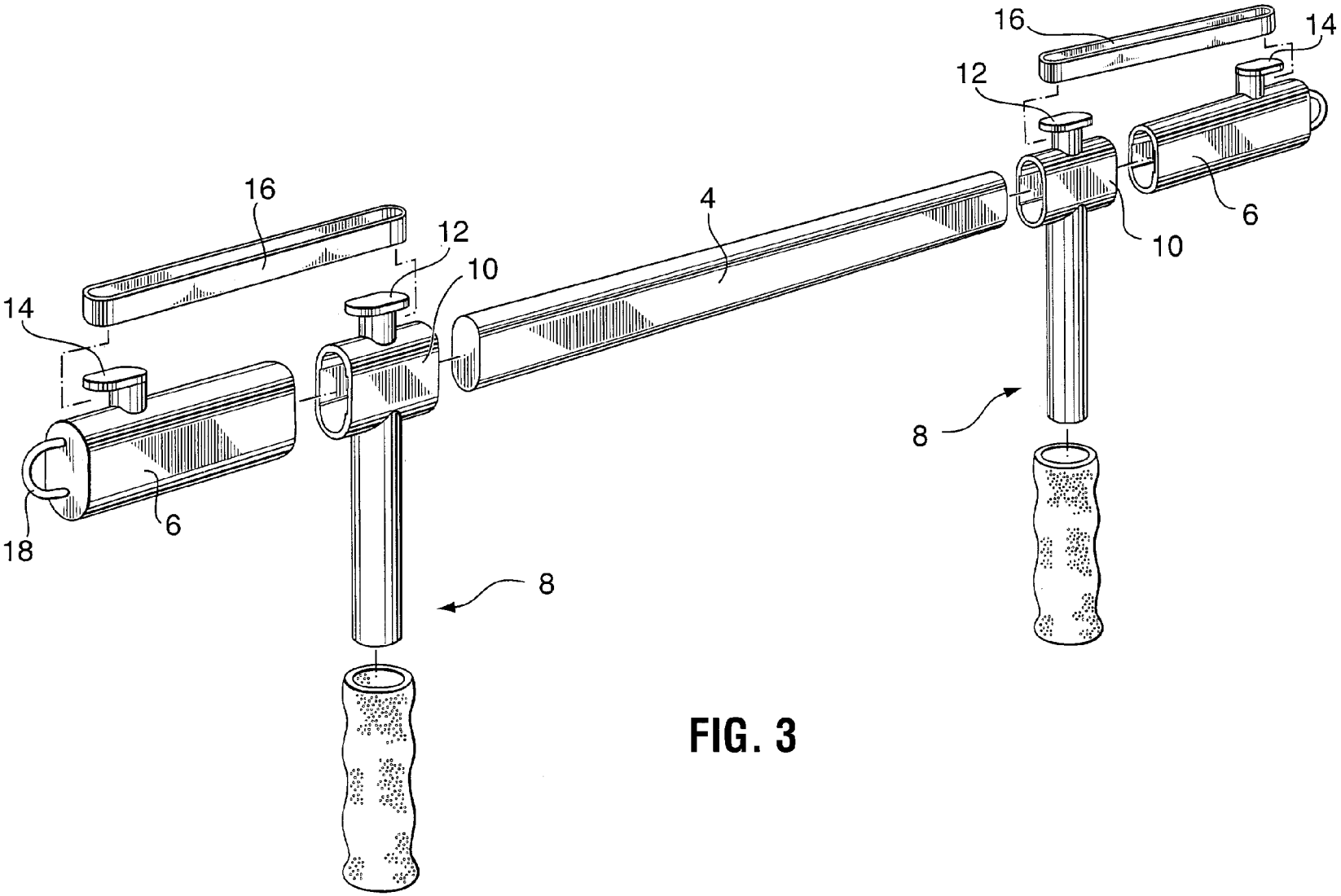
FIG. 3 is an exploded view of the device of FIG. 1, showing its component parts and their interrelationship.

Turning to FIGS. 1 and 2 there is illustrated a portable personal exercise device 2 configured, as illustrated, for use for doing basic chest presses or advanced chest presses. Device 2 comprises an elongated linear rigid bar 4 with opposing ends, and an anchor sleeve 6 fixedly secured to each end. A pair of handles 8 are slidably mounted to the bar 4 by way of handle sleeves 10. As can be seen in the section view of FIG. 2, bar 6 is configured to be of obround, rectangular or other such cross-sectional configuration so that handle sleeves, which are configured to be slidably seated on bar 4, will not rotate relative to bar 4, but will move only in a linear direction parallel to the longitudinal axis of bar 4. The handles 8 and handle sleeves 10 are restricted in their outward movement on bar 4 by their corresponding anchor sleeves. Handles 8 preferably extend outwardly from bar 4 at a 90° angle, as illustrated.

Handle sleeves 10 are provided with aligned projections 12, and anchor sleeves 6 are provided with similar aligned projections 14 for releasably securing one or more elastic bands 16 in alternative arrangements, alternatively to bias handles 8 against relative movement towards or away from each other or towards or away from corresponding anchor sleeves 6, as will be described in more detail hereinafter. To the ends of bar 4 are secured attachment loops 18. Linear elastic lines 20 (FIG. 5), each provided at one end with a handle 22 or an ankle strap (not illustrated) and at the other end with a clip 24 for releasable attachment to attachment loops 18, are provided to increase the number and variety of exercises which can be performed using device 2. Linear elastic lines may be formed from rubber tubing, bungee cord or any other suitable elastic material.

Figure 4A:
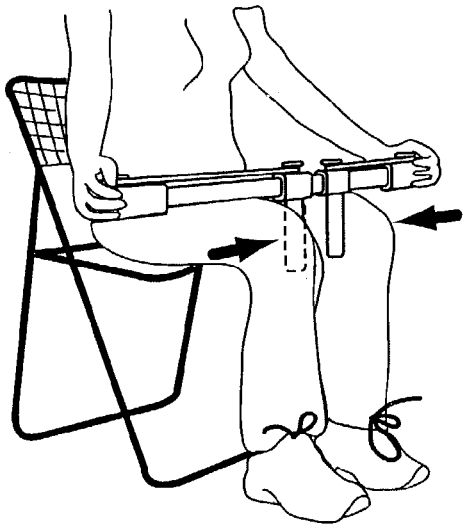
FIGS. 4*a*, 4*b*, 4*c* and 4*d* are perspective views of the device of FIG. 1 respectively illustrating a variety of exercises which can be carried out using the device.
Figure 4B:
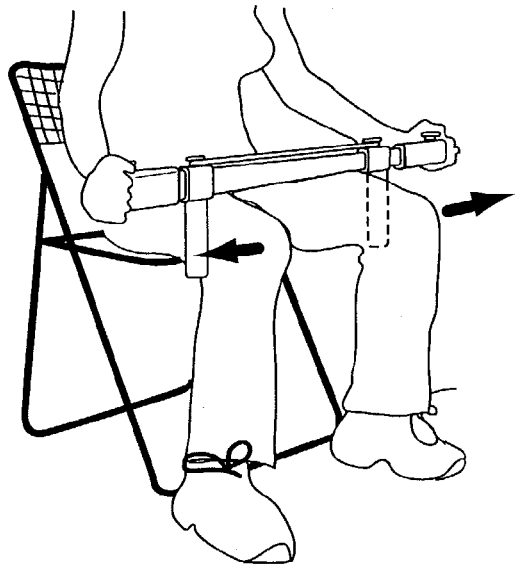
Figure 4C:
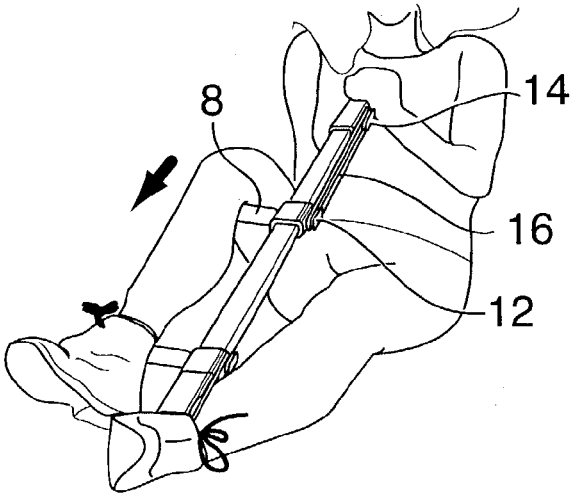
Figure 4D:
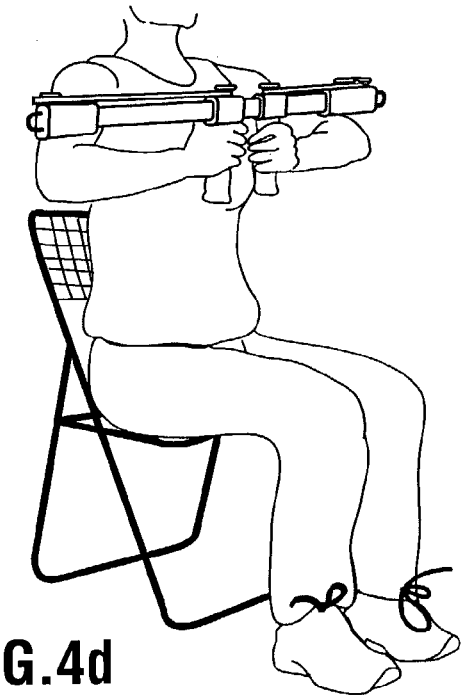

The device 2 according to the present invention is illustrated, in FIGS. 1 and 4*d* as being configured and used for either a basic chest press or advanced chest press exercise. In this configuration, two bands 16 are used, one being releasably secured to anchor sleeve projection 14 and handle sleeve projection 12 of the sleeve 10 of adjacent handle 8, and the other band 16 similarly releasably secured to the other pair of projections 12 and 14. In this way, the handles are biased against relative movement towards each other and away from their corresponding anchor sleeves.

This same arrangement of bands may be used for the inner thigh exercise illustrated in FIG. 4*a*.

For the outer thigh exercise illustrated in FIG. 4*b*, a single band 16 is releasably secured to the two handle sleeve projections 13, thereby providing bias against relative movement of the handles away from each other. The user's legs are then seated between the handles and outward movement of the legs, at the knees, against the bias of handles 8, provides the exercise required. In the configuration of device 2 illustrated in FIG. 4*c* intended for exercising and shaping a persons buttocks, a single band 16 is releasably secured to the projections 12 and 14 of a pair of adjacent handle sleeves 10 and anchor sleeves 6, providing bias against relative movement of that corresponding handle 8 away from corresponding anchor sleeve 6. When the device is oriented as illustrated in FIG. 4*c*, with the user's leg over the biased handle 8, downward pressure of that leg on that handle provides exercise to the user's (right) buttock. The other buttock may be exercised by simply flipping the device over to the other side, so that the user's other (left) knee is then over the biased handle 8.

Other exercises that may be performed using the device 2 with appropriate arrangement of the bands include triceps push downs, arm rows, biceps curls, internal and external rotation cuff rotations and leg presses and leg kick-backs.

Figure 5A:
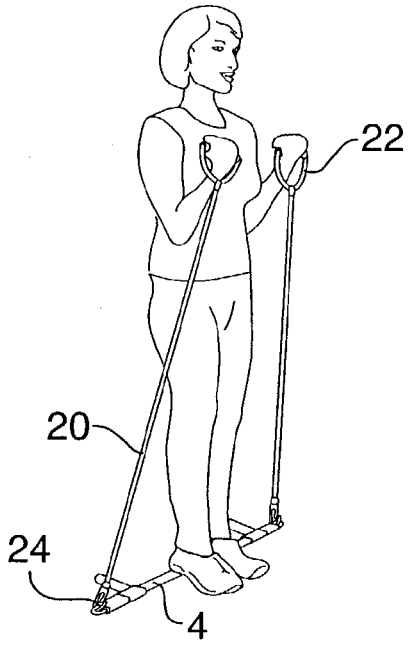
FIGS. 5*a*, 5*b*, 5*c*, 5*d* and 5*e* are perspective views of an alternative embodiment of the present invention again showing variety of exercises which can be carried out; and While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.
Figure 5B:
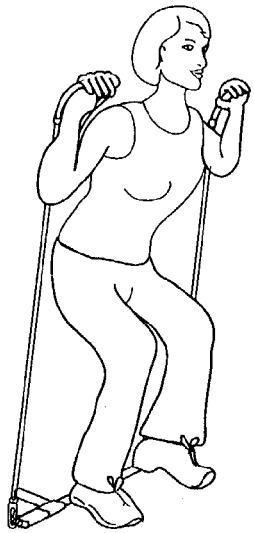
Figure 5C:
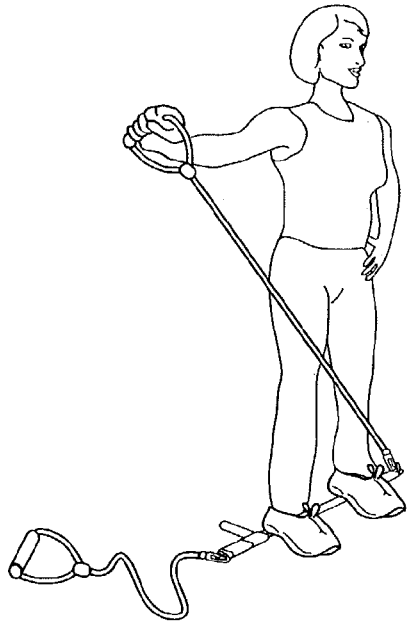
Figure 5D:
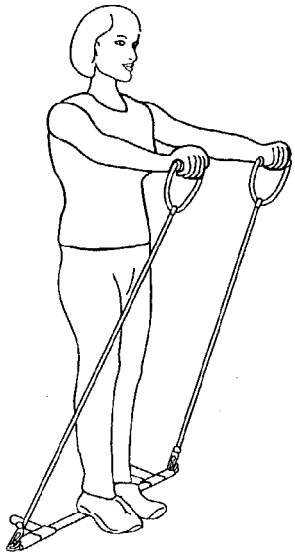
Figure 5E:
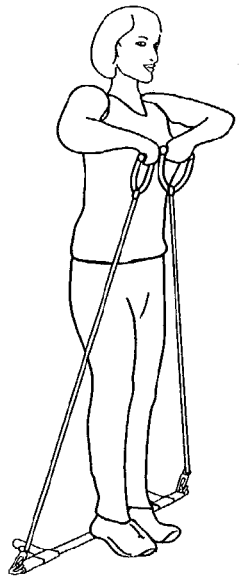

When the linear elastic lines 20 are secured to loop attachments 18 as illustrated in FIGS. 5*a, b, c, d* and *e*, with the user standing on the bar 4 to anchor it, bicep curls (FIG. 6*a*) squats (FIG. 6*b*) side lateral raises (FIG. 6*c*), straight arm raises (FIG. 6*d*) and upright rows (FIG. 5*e*) are some of the additional exercises which can be carried out. Further leg exercises may be carried out when handles 22 are replaced by ankle straps. Thus, with a simple and economically constructioned exercise device, a wide variety of exercises can be effectively carried out.

Thus, it is apparent that there has been provided in accordance with the invention an exercise device that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim:

1. A portable personal exercise device comprising an elongated, linear rigid bar with opposing ends, an anchor sleeve fixedly secured to each end and a pair of handles mounted to the bar for only linear sliding movement between the anchor sleeves, the handles extending outwardly from the bar, the anchor sleeves defining the limits of movement of the handles toward the ends of the bar, the handle sleeves and anchor sleeves provided with aligned, parallel projections for releasably securably receiving one or more elastic bands in alternative arrangements so as alternatively to bias the handles with respect to each other or with respect to the anchor sleeves against relative movement towards or away from each other or towards or away from corresponding anchor sleeves, whereby a variety of exercises may be performed.

2. A device according to claim 1 in combination with a pair of elastic bands, one band releasably secured to the projection of one of the handles and the projection of the corresponding anchor sleeve and the other elastic bands releasably secured to the projection of the other handle and its corresponding anchor sleeve, whereby the handles are biased against relative movement towards each other.

3. A device according to claim 1 in combination with an elastic band releasably secured to the projections of the handles, whereby the handles are biased against relative movements away from each other.

4. A device according to claim 1 in combination with an elastic band releasably secured to the projection of one of the handles and the projection of the corresponding anchor sleeve to bias that handle against relative movement away from the corresponding anchor sleeve.

5. A device according to claim 1, wherein the bar is of rectangular cross-section and the handle sleeves are of rectangular configuration so as to prevent relative rotative movement of the handles with respect to the bar.

6. A device according to claim 1, wherein the handles extend outwardly from the bar at an angle of 90°.

7. A device according to claim 5, wherein the handles extend outwardly from the bar at an angle of 90°.

8. A device according to claim 1 further provided with an attachment loop secured to each end of the bar.

9. A device according to claim 8 further provided with a pair of linear elastic lines, each releasably securable to one of the attachment loops, each linear attachment line provided at one end with a handle and at the other with a clip for releasable attachment to the attachment loops.

* * * * *